United States Patent [19]

Lapinski et al.

[11] 4,089,136

[45] May 16, 1978

[54] WEATHER EXCLUDER

[75] Inventors: Richard Lapinski, Fairfield West; Marian Richard Matusjewski, Bankstown, both of Australia

[73] Assignee: Catuma Pty. Ltd., Australia

[21] Appl. No.: 693,183

[22] Filed: Jun. 7, 1976

[51] Int. Cl.[2] ..... E06B 7/21

[52] U.S. Cl. ..... 49/308; 49/310

[58] Field of Search ..... 49/306–309, 49/310–312

[56] References Cited

U.S. PATENT DOCUMENTS

| | | | |
|---|---|---|---|
| 325,237 | 9/1885 | Chase et al. | 49/308 |
| 2,108,459 | 2/1938 | Voorhees | 49/308 |
| 2,250,821 | 7/1941 | Bedol | 49/308 |
| 2,253,281 | 8/1941 | Marx et al. | 49/308 |

*Primary Examiner*—Kenneth Downey

*Attorney, Agent, or Firm*—Holman & Stern

[57] ABSTRACT

A weather excluder for attachment at the foot of a door which includes a closure member capable of vertical movement towards the floor upon closing of the door and away from the floor upon opening the door, characterized in that two jamb engaging members are provided which each contact one of the jambs of the door and which each provide one stage in the vertical movement of the closure member.

8 Claims, 8 Drawing Figures

WEATHER EXCLUDER

BACKGROUND OF THE INVENTION

This invention relates to weather excluders, of the type designed for mounting at the bottom of a door to close the gap which is otherwise present between the bottom of the door and the floor or threshold when the door is closed.

One known form of weather excluder of this type comprises a member, referred to hereinafter as a "closure member" which is vertically movable to close the gap beneath the door, the closure member moving in response to the engagement or disengagement of a horizontally protruding member, with the door jamb on the hinge side of the door.

Such a device suffers from the disadvantage that only a small length of movement of the horizontally projecting member can be achieved with the given geometry of conventional doors, and this limits the amount of vertical travel of the closure member which can be produced with compact and simple mechanisms.

If in order to maximize the vertical travel of the closure member, the horizontally projecting member in its free condition projects very far from the edge of the door, the closure member will be lowered into contact with the floor too early in the closing movement of the door, making it difficult to shut and open the door, and causing wear to floor coverings such as carpet.

A further disadvantage of prior art devices has been that the simple mechanism used for translating the horizontal movement of the jamb-engaging member into vertical movement of the closure member, has resulted in a horizontal component of displacement of the latter during vertical movement thereof, with consequent misalignment of the closure member.

SUMMARY OF THE INVENTION

The present invention has as its object the mitigation of these problems present in the prior art, and is characterized in that the raising and lowering of the closure member is achieved in two stages by a double action mechanism, operated first (in the closing of the door) by contact with the jamb at the hinge side, and subsequently, in the final part of the closing movement, by contact with the jamb at the lock side.

In this way, during closing of the door, the final movement of the closure member into contact with the floor occurs at the last possible moment, but this final movement provided by engagement with the lock-side jamb need not be extensive as the closure member has been partially lowered by the prior engagement of the device with the hinge-side jamb.

Furthermore, by appropriating arranging the mechanism, the horizontal components of the movement of the excluder member during each stage can be arranged to be substantially equal and opposite, so the horizontal alignment of the closure member in its extreme positions of vertical movement can be substantially the same.

The invention broadly comprises a weather excluder for attachment at the foot of a door comprising a closure member capable of vertical movement towards the floor upon closing of said door and away from the floor upon opening of said door, first means engaging the hinge side door jamb to provide one stage of said vertical movement, and second means engaging the lock side door jamb to provide another stage of said vertical movement.

Preferably the mechanism of the excluder comprises a pair of parallel bars each capable of independent longitudinal movement and co-operating with the jamb-engaging means, the closure member being coupled to these bars by pairs of links, the links of a given pair each having one end pivotally connected at a common point to the closure member, the free ends of the links of each pair being respectively pivotally connected to the bars.

Preferably, the bars are resiliently biased towards a rest position corresponding to the open position of the door, and stops co-operating with the bars limit the extent of movement of the bars in each direction.

The invention is applicable both to weather excluders designed for mounting within the bottom of the door, and those designed for mounting on an external surface of the door, both such mounting techniques being well known in the prior art. The weather excluder of the present invention is suited to be manufactured from metal or plastics.

BRIEF DESCRIPTION OF THE DRAWINGS

The invention will now be described, by way of example only, with reference to the accompanying drawings in which.

DETAILED DESCRIPTION OF THE PREFERRED EMBODIMENTS

Figures 1, 2, 3, 4, 5, 6, 7, 8:
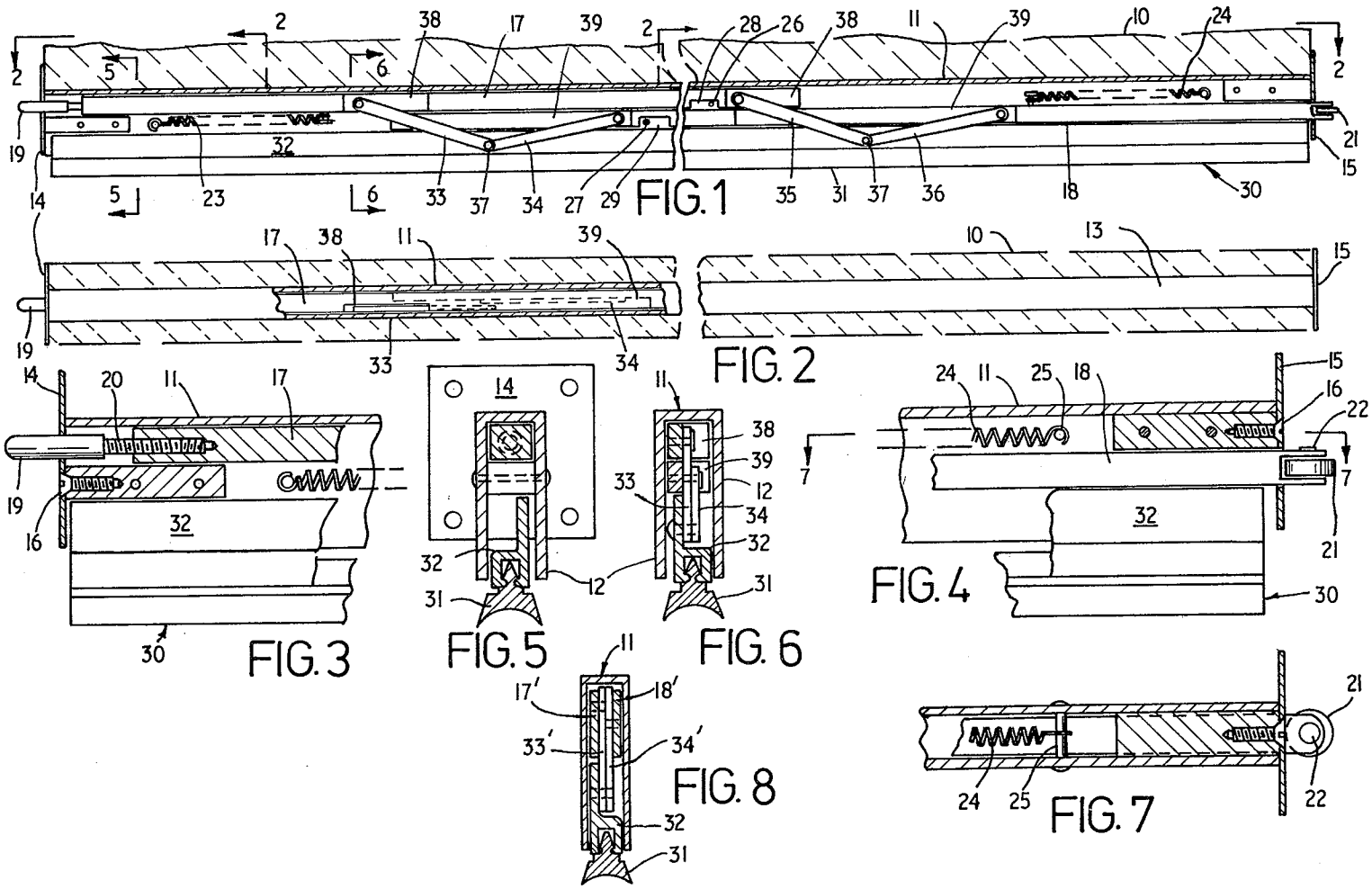
FIG. 1 is a sectional side elevation of an embodiment of the invention mounted within a door.
FIG. 2 is a sectional view taken along line 2—2 of FIG. 1.
FIG. 3 is a fragmentary sectional elevation showing in detail the construction of one end of the draft excluder shown in FIG. 1.
FIG. 4 is a fragmentary sectional elevation showing the other end of the draft excluder of FIG. 1.
FIG. 5 is a cross section taken along line 5—5 of FIG. 1.
FIG. 6 is a cross section taken along line 6—6 of FIG. 1.
FIG. 7 is a sectional plan view taken along line 7—7 of FIG. 4.
FIG. 8 shows in cross section an alternative arrangement of the elements of the excluder.

While the illustrated embodiments show a form of the invention adapted for construction from a suitable metal such as aluminum, it will be apparent that the principles of the invention may be applied with suitable modifications within the competence of those skilled in the art, to a weather excluder constructed entirely of plastics.

Referring now to the drawings, FIG. 1 shows a draft excluder mounted within the bottom of a door 10. The excluder comprises a housing 11 consisting of an extruded channel section having side flanges 12 (FIGS. 5 and 6). The housing 11 is fixed within a channel 13 provided within the foot of the door 10 and is fixed to the door by means of mounting screws (not shown) provided in a pair of end plates 14 and 15 which are themselves fixed to the housing by means of screws 16.

Mounted for longitudinal movement within the housing 11 are a pair of bars 17, 18, which function, in conjunction with a linkage to be described below, to transfer to a closure member (also described below), movement of protruding members which contact respective jambs of the doorway when the door is closed.

At the outer end of the bar 17 there is provided a jamb-contacting member 19 which is intended to engage the door jamb at the hinge side of the door. This member 19 extends beyond the edge of the door through an aperture provided in the end plate 14, and is attached to the bar 17 by means of a threaded portion 20 which allows longitudinal adjustment of the member 19 to achieve the correct total length of travel of the closure member.

At the outer end of the bar 18 there is provided a jamb-contacting member 21 which consists of a small wheel mounted on a pin 22 in a slot provided in the end of the bar 18. This member 21 is provided for contact with the door jamb at the lock side of the door. Preferably the door jamb is provided with plates (not shown) which are struck by the members 19 and 21 to avoid wear of the door jamb itself. Preferably the plate provided for co-operation with the member 21 also provides a ramp upon which the member rides during closing or opening movement of the door, thereby providing continuous movement of the member 21 during its engagement with the plate.

The bar 17 is biased towards the outwardly extended position of its member 19 by means of a helical spring 23 the stationary end of which is attached to a pin passing through the flanges 12 of the housing 11. Similarly, the bar 18 is biased towards the outwardly extended position of its member 21 by means of a similar spring 24. FIGS. 4 and 7 show a pin 25 by which the stationary end of this spring 24 is mounted in the housing 11.

The extent of travel of each bar 17 and 18 is limited by the provision of a pair of pins 26 and 27 respectively, which co-operate with the ends of a pair of slots 28 and 29 provided in the respective bars.

A closure member 30 comprising a flexible strip 31 mounted within an extruded rigid supporting member 32, is supported from the bars 17 and 18 by means of two pairs of links 33, 34 and 35, 36. The links 33 and 35 are pivotally attached at one end to the bar 17 and at their other end, as shown at 37, to the supporting member 32. Similarly, the links 34 and 36 are attached at one end to the bar 18 and at their other end to the supporting member 32 at the same points 37. The bars 17 and 18 are relieved, as shown respectively at 38 and 39, in the region of movement of the links to reduce the necessary width of the assembly.

The operation of the weather excluder thus described above is as follows. Assuming that the door in which the excluder is mounted is initially open, then during closing movement of the door the member 19 will first come into contact with the hinge side jamb and with continued closing movement of the door the member 19 will move the bar 17 inwardly. As the bar 18 is prevented from movement in the same direction by engagement of the pin 27 with the end of the slot 29, the pivot points 37 will move downwardly and somewhat to the right (when viewed as in FIG. 1), and the closure member 30 will move in a similar direction so that the first stage of the downward movement of the member 30 is produced. Subsequently, the member 21 will come into engagement with the striking plate provided on the lock side jamb, thereby moving the bar 18 inwardly. As the bar 17 cannot move in the same direction due to the engagement of its member 19 with the opposite jamb, the pivot points 37 and the closure member 30 will move downwardly and somewhat to the left (when viewed as in FIG. 1), and upon full closure of the door this second stage of downward movement of the closure member will be complete with the strip 31 in contact with the floor or threshold.

As mentioned above, the weather excluder of the present invention is equally applicable to mounting within the door as shown in FIGS. 1 to 7, and to mounting on the external face of the door. In the latter application of the invention, to achieve a narrower profile, the configuration of bars and links shown in FIG. 8 may be adopted. FIG. 8 shows a pair of thin bars 17' and 18' mounted in side-by-side relationship, the links 33' and 34' lying between the bars. In this application of the invention, means (not shown) must of course be provided for fixing the housing 11 to the face of the door.

While the invention has thus been described with reference to specific embodiments, it will be appreciated that principles of its operation are applicable in other ways, and many modifications within the scope of the invention will be apparent to those skilled in the art.

We claim:

1. A weather excluder for attachment at the foot of a door comprising: a closure member capable of vertical movement towards the floor upon closing of said door and away from the floor upon opening of said door; first means engaging the hinge side door jamb to provide a first stage of said vertical movement uniformly over the full length of the closure member; second means engaging the lock side door jamb to provide a further stage of said vertical movement uniformly over the full length of the closure member; a pair of parallel bars each capable of independent longitudinal movement, said bars co-operating respectively with said first and second means, said closure member being coupled to said bars and said bars are each resiliently biased toward a rest position corresponding to the open position of the door; and a pair of parallel links coupling each of the bars to the closure member, each link being pivotally connected at one end to one of the bars and pivotally connected at its other end to the closure member.

2. The weather excluder as claimed in claim 1 wherein the links of a given pair each have one end pivotally connected at a common point to the closure member.

3. The weather excluder as claimed in claim 1, further comprising stops co-operating with said bars limiting the extent of movement of said bars in each direction.

4. The weather excluder as claimed in claim 1 wherein said first and second means comprise first and second members extending outwardly of opposite sides of the door when the latter is open, said first member being longitudinally adjustably connected to one of said bars.

5. The weather excluder as claimed in claim 4 wherein said second member comprises a wheel mounted at the outer end of its associated bar for rotation about a vertical axis.

6. The weather excluder as claimed in claim 1 wherein said closure member comprises a resilient floor-or threshold-contacting member mounted on a rigid supporting member, said links being attached to said supporting member.

7. The weather excluder as claimed in claim 1 wherein said bars are mounted within a housing one above the other, the surfaces of said bars to which said links are attached being relieved in the region of said links.

8. The weather excluder as claimed in claim 1 wherein said bars are mounted in a housing in side-by-side relationship, said links being attached to the opposed adjacent surfaces of said bars.

* * * * *